United States Patent [19]

Weikel, Jr. et al.

[11] 4,234,249

[45] Nov. 18, 1980

[54] TRACKING POWER SUPPLY FOR AC AND DC COROTRONS

[75] Inventors: Donald J. Weikel, Jr., Rochester, N.Y.; John Hartman, Reseda, Calif.

[73] Assignee: Xerox Corporation, Stamford, Conn.

[21] Appl. No.: 956,780

[22] Filed: Nov. 1, 1978

[51] Int. Cl.[3] ..... G03G 15/00

[52] U.S. Cl. ..... 355/3 CH; 355/14 CH; 361/235

[58] Field of Search ..... 307/2, 17, 22, 58; 250/325, 326; 355/3 CH, 14 CH; 361/235; 323/24; 363/86, 89

[56] References Cited

U.S. PATENT DOCUMENTS

| | | | |
|---|---|---|---|
| 3,287,623 | 11/1966 | Valancius | 307/22 |
| 3,819,942 | 6/1974 | Hastwell | 361/235 |
| 4,138,635 | 2/1979 | Quinn | 323/21 |

*Primary Examiner*—William H. Beha, Jr.
*Attorney, Agent, or Firm*—Michael H. Shanahan

[57] ABSTRACT

An electrophotographic copying system is disclosed that employs a mixture of AC and DC corotrons energized by a common power supply. The DC corotrons are energized with an unfiltered, rectified AC voltage derived from the same source as the AC voltage applied to the AC corotrons so that all the corotrons are driven by voltages having a common wave shape. One of the corotrons is regulated by a feedback circuit coupled between the regulated or master corotron and the power supply. The other corotrons track the regulation of the master corotron.

32 Claims, 9 Drawing Figures

VOLTS
$V_t$
0
TIME →
$V_T$=CORONA THRESHOLD
(POSITIVE CHARGING)
41
39
42
40

VOLTS
$V_3$
$V_4$
$V_{t_1}$
$V_{t_2}$
TIME →
43
44

VOLTS
$V_t$
0
$-V_t$
TIME →
$V_T$=CORONA THRESHOLD
(POSITIVE CHARGING)
$V_T$=CORONA THRESHOLD
(NEGATIVE CHARGING)

VOLTS
$V_5$
$V_{t_1}$
$V_{t_2}$
TIME →
45
46

TRACKING POWER SUPPLY FOR AC AND DC COROTRONS

BACKGROUND OF THE INVENTION

This invention relates to electrostatographic imaging systems. More specifically, the present invention is directed toward a power supply for regulating the charging currents for a plurality of corotrons in an electrostatographic system.

The currents generated by corotrons in electrostatographic systems have been regulated by various feedback techniques. Typically, the shield current, the plate current, or a grid current in the case of a scorotron, is detected and used to develop an error signal. The error signal is fed back to the power supply to increase or decrease the input voltage or current to compensate for the detected error. The reason for the regulation is to correct for changes in the ambient conditions of temperature and humidity, for coronode wire to plate spacing and for changes in capacitance such as that due to transfer paper thickness variations or photoconductor, i.e., the plate, thicknesses variations. In other words, the regulation of corotron current is to compensate for current fluctuations under changing load conditions.

The prior art electrostatographic imaging systems, specifically electrophotographic imaging systems, often choose to ignore the load variation to a particular corotron and do not provide any feedback regulation. When regulation is provided, it is most commonly applied to the charging corotron since its function is extremely important. It is known to have the charging corotron regulated and the transfer, detack and erasing or leveling corotrons operated in open loop. It is most common for all the corotrons to be operated in open loop.

Input line voltage regulation has been provided for corotrons by using a controlled voltage transformer, CVT. The input voltage coupled to the primary of a CVT can vary a significant amount without causing a change in the current in the secondary or output windings. This is an important feature in most applications since line voltage often varies as much as plus or minus ten percent. Nonetheless, the CVT does not provide regulation for the corotron due to changes in ambient and other load parameters.

SUMMARY

Accordingly, it is a primary object of the present invention to regulate a plurality of corotrons in an electrostatographic system.

A more specific objective of the invention is to regulate the current of a corotron and cause the current in at least one other corotron to track or follow the error signal of the regulated corotron. The tracking corotrons have their currents regulated for commonly experienced variation including temperature, humidity and composition of the ambient gas, i.e. air, from which the corona is manufactured.

Still another object of our invention is to achieve close regulation of a tracking corotron having a large AC component.

Even a further object of the instant invention is to detect an error signal at a master corotron which has an unfiltered, rectified AC voltage coupled to its coronode (a wire being an example) and to vary the voltage applied to the coronode to drive the error to zero.

A further object of the invention is to apply a voltage having the same fundamental wave shape to a plurality of commonly regulated corotrons so that the variations in current or voltage at one corotron will give rise to a feedback signal that correctly compensates for the variation.

Yet another object of our invention is to full wave rectify, a generally sinusoidal AC voltage, apply the rectified voltage, unfiltered, to the coronode of an electrostatographic charging corotron, detect the shield current of the charging corotron and regulate the voltage of a power supply to which the charging and other corotrons are coupled.

It is also an object of the present invention to design a low cost, high performance power supply for an electrophotographic imaging system having a copy making speed of about 3 to 6 inches per second.

Another object of this invention is to use voltages with a large AC component to power all the corotrons in an electrophotographic copying machine.

The foregoing and other objects of our invention are achieved by applying a common AC or DC pulsating voltage to all the corotrons sought to be commonly regulated. Specifically, an unfiltered, rectified AC voltage is applied to charging and transfer corotrons in an electrophotographic copying machine. Detack and erase corotrons used by the machine have the same AC voltage applied to them that is applied to the rectifier powering the charging and transfer corotrons. The shield current of the charging corotron is coupled to a feedback circuit to stabilize the corotron. Because of the commonality of wave shape of all the voltages coupled to the multiple corotrons, the corrections made by the feedback circuit for variations at the charging corotron also correct for variations at the transfer, detack and erase corotrons.

PRIOR ART STATEMENT

Codichini et al, U.S. Pat. No. 3,275,837 discloses a DC biased AC voltage for operating charge, transfer and preclean (erase) corotrons. The DC bias causes the peak AC voltage to exceed a corona threshold each half cycle. There is no feedback circuit. However, a CVT is used to compensate for fluctuations to the input AC line voltage. All three corotrons are functionally DC corotrons in that they deposit charge of a single polarity on a photoconductive surface. In contrast, the AC corotron deposits charge onto a surface of both positive and negative polarity even though in unequal amounts resulting in a net charge of one polarity. The preceeding definitions for DC and AC corotrons are used herein.

Fisher, U.S. Pat. No. 3,805,069 discloses a DC corotron having feedback from a corotron shield back to a DC power supply to regulate a constant level voltage coupled to the coronode. Fisher merely describes regulation of a single DC power supply for a single corotron. It does not disclose that the error signal at one corotron can be used to regulate that corotron as well as other slave or tracking corotrons coupled to the same power supply.

Codichini et al, U.S. Pat. No. 3,335,274 discloses a regulation scheme for a scorotron. A scorotron is a corotron that includes a grid coupled to a DC potential for limiting the ion current to the surface being charged in addition to a coronode and shield. Again as with Fisher, this patent is solely concerned with a single DC power supply and corotron and does not provide any teaching relative to tracking corotrons.

Ukai, U.S. Pat. No. 3,699,388 discloses a DC corotron regulation circuit wherein a probe inserted inside the corotron shield is used to develop a feedback signal. The coronode wire is coupled to a half wave rectified, filtered DC potential which, presumptively, has an AC ripple. The filtered, rectified voltage is varied by a feedback circuit coupled between the probe and the primary or low voltage side of an input transformer coupled to the line source. Here also, only one corotron is being regulated and a filtered rather than an unfiltered, rectified AC voltage is coupled to the coronode.

Snelling, U.S. Pat. No. 3,604,925 discloses a DC corotron coupled to a high voltage power supply in turn coupled to a 110 volt, 60 hertz line source. A feedback signal is developed by a probe positioned outside the shield adjacent the surface to be charged. The corotron regulation is accomplished by a variable resistor in the high voltage circuit coupled to the coronode. The variable resistor is a light sensitive diode in series with the output of the power supply. A lamp in a low voltage circuit has its light directed onto the light sensitive diode. An error signal derived from the corotron causes the intensity of the light emitted by the lamp to change which in turn corrects the voltage to the corotron. This disclosure, like the others taken alone or together, falls short of the common wavewave shape tracking power supply of the instant invention.

THE DRAWINGS

The foregoing and other objects and features of the present invention will be apparent from the present specification alone and in combination with the drawings which are:

DETAILED DESCRIPTION

A corotron is a device for generating ions from ambient gas, e.g. air. As used herein, a DC corotron is one used to deposit ions of one polarity onto a surface whereas an AC corotron is one used to deposit both positive and negative ions onto a surface not necessarily in equal quantities. Typically, a corotron is a thin conductive wire extended parallel to a surface, commonly called the plate, sought to be charged. A high, roughly 4000 volts, potential difference coupled between the plate and wire gives rise to a corona about the wire. The corona is a cloud of ions generated from air molecules due to the high density electric field near the surface of the wire or coronode. Also, a corotron often includes a shield that is parallel to and partially surrounds the wire on the side opposite the plate. The shield is a conductor normally at the same electric potential as the plate, e.g. ground. The electric field between the wire and shield is itself adequate to cause a self-sustained ionization of the air, i.e. generation of the corona cloud.

The simple wire to plate geometry, in many applications, results in ion currents to the plate that are much larger than needed. The shield plays the role of limiting the ion flow to the plate. Its presence insures the generation of the ion cloud and its opening on the side facing the plate is selected to permit a limited but controlled ion flow to the plate.

The corona occurs at a threshold potential which varies with changes in temperature, humidity, the composition of the gases in the air and other variables. In practice, the shield to wire spacing is constant whereas the wire to plate spacing is subject to variations. These variations as well as the capacitance variations associated with the copy paper between the wire and plate, for example, effect the operation of a corotron.

The shield current, the plate current or the currents associated with a probe positioned adjacent the shield, wire or plate are all indicative of the charging operation and are used in feedback networks. The patents cited in the above Prior Art Statement give examples of these various feedback techniques.

An electrostatographic imaging system is one in which ions (as well as free electrons) are collected in areas on an insulating surface in patterns that have a shape corresponding to an image. This shaped, charged surface is a latent electrostatic image. An example of such a system is one wherein an insulating surface is uniformly charged by a corotron and then selectively discharged in background areas by a grounded conductive needle or stylus. A complementary system is one wherein the charged area is constructed point by point by moving a stylus in a raster pattern. The small area under the tip of the stylus (a coronode) is charged by ions generated by selectively coupling a high potential between the stylus and a conductive substrate.

Figure 1:
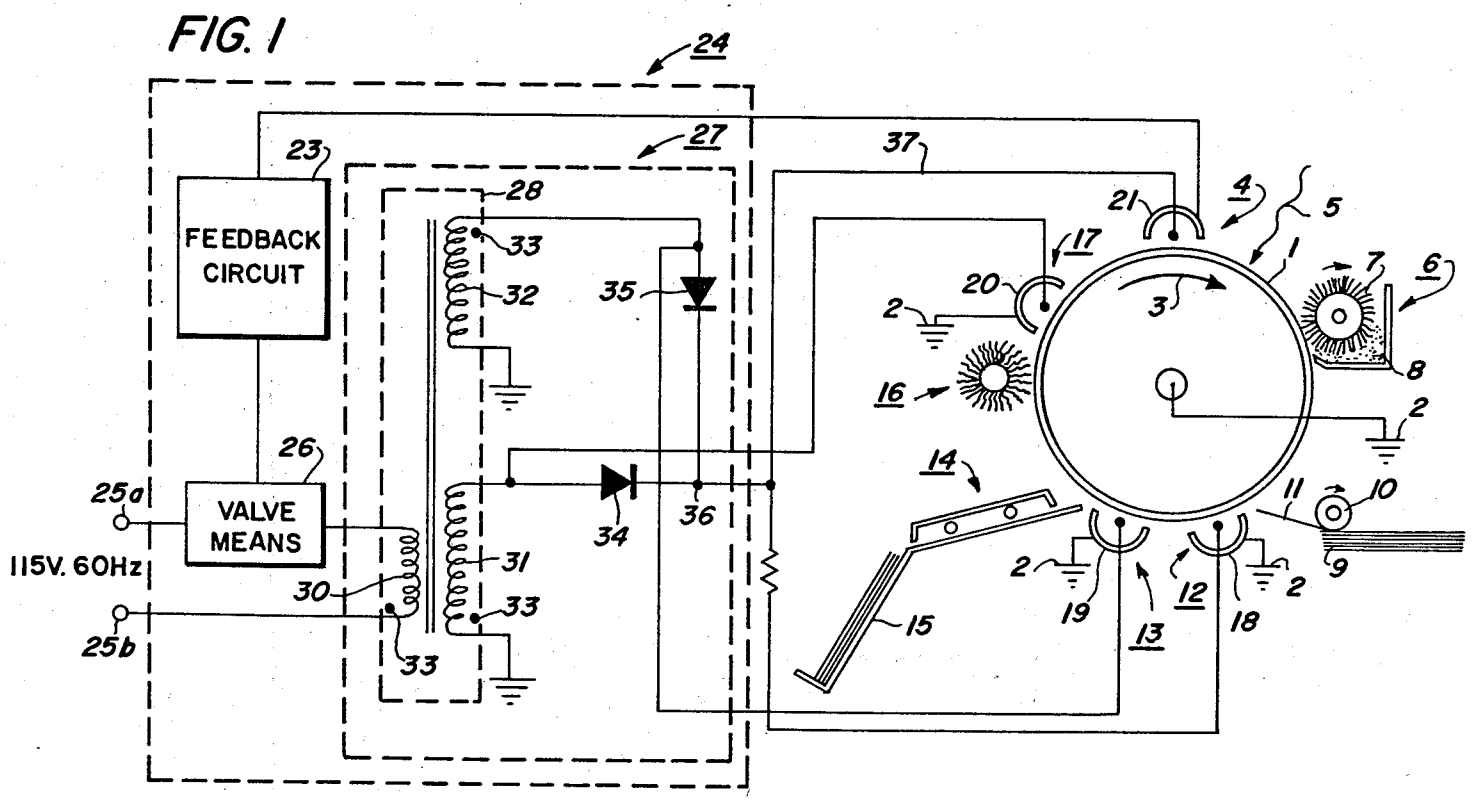
FIG. 1 is a schematic of an electrophotographic copying machine employing a tracking high voltage power supply for AC and DC corotrons used in the machine.
Figure 1A:
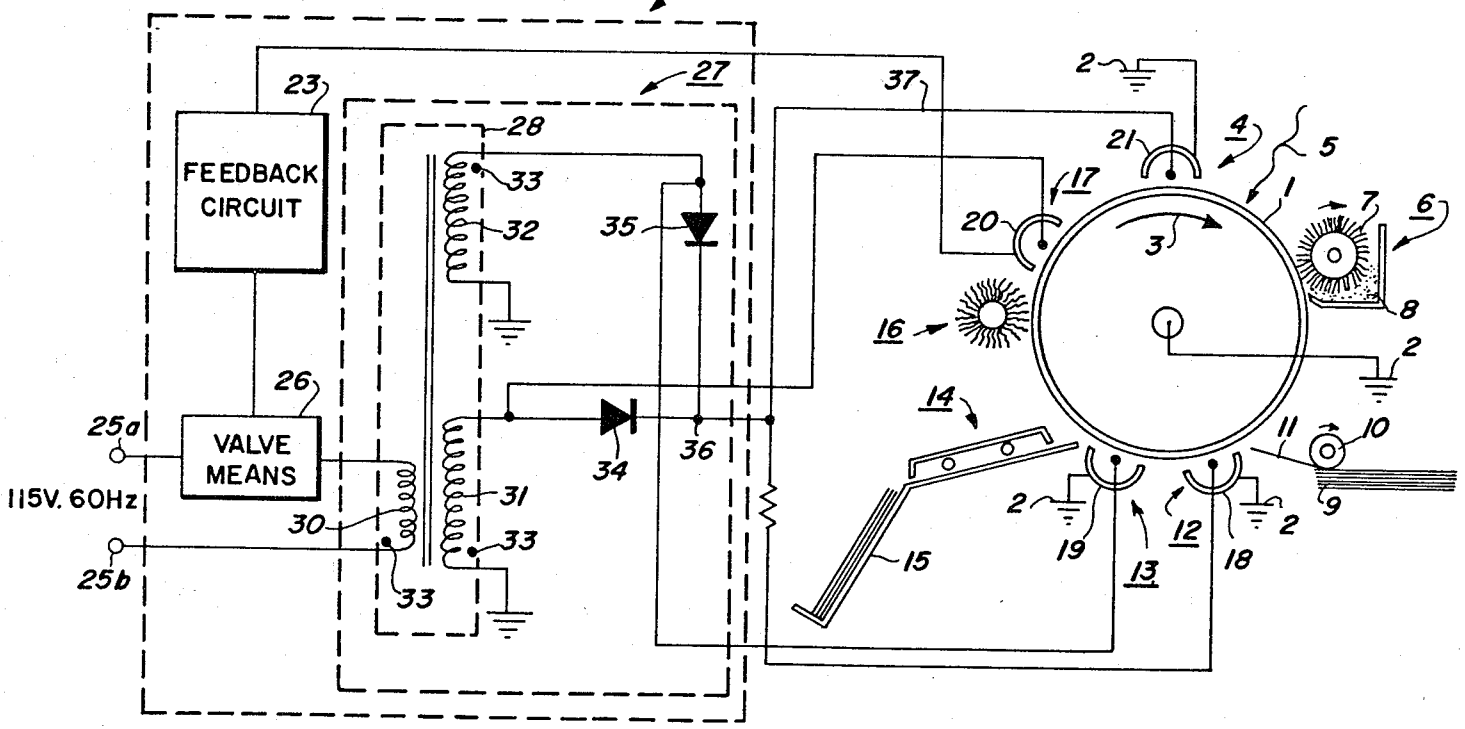
FIG. 1A is a schematic of an electrophotographic copying machine employing a tracking high voltage power supply similar to that in FIG. 1 except the feedback means is connected to an AC corotron rather than a DC corotron.

An electrophotographic imaging system is an electrostatographic system using light to create the latent electrostatic image. FIG. 1 schematically depicts one example of such a system. The photoconductive drum 1 includes a conductive cylinder journalled for rotation. The conductive cylinder is electrically grounded as indicated by means 2. A photoconductive layer of selenium alloy, for example, is coated over the outer periphery of the drum. As the drum rotates in the direction of arrow 3, the charging corotron 4 deposits ions, e.g. positive ions, across the width of the drum. i.e. the corotron charges the surface of the drum. This is done in the dark.

At exposure station 5, the charged drum surface is exposed by well known lens and lamp apparatus (not shown) to electromagnetic radiation (referred to as light) in the form of an image. The light image discharges the drum in selected areas corresponding to its image. The resultant charge pattern is a latent electrostatic image.

At development means 6, the latent electrostatic image is developed, i.e. made visible with a toner material. The development means includes a magnetic roller 7 journalled for rotation. A developer mix 8 of magnetic carrier particles and electrostatically charged toner particles is brushed against the latent image as roller 7 rotates. The toner is electrostatically attracted to the latent image giving rise to a developed toner image.

Synchronously with the rotation of the drum, the top sheet of plain paper in the stack 9 is fed by a feed roller 10 over a guide 11 into registrated contact with the developed toner image. The DC transfer corotron 12 deposits positive ions on the backside of the sheet of paper. The side in contact with the toner image and drum is the front side for present purposes. The transfer corotron charges the back of the paper to a level to electrostatically transfer the toner from the drum to the paper. In the system being described, as an example, the toner particles making up the toner image have a net negative charge that effects the transfer. Generally the charge level on the toner is comparatively low and can be ignored. The drum is initially charged to about 800 volts which is reduced in heavily exposed areas down as far as about 100 volts. The back of the paper is nominally charged to about 1200 volts.

The electrostatic force associated with the charge on the back of the paper causes the sheet to be strongly attached to the drum. To help separate the sheet and its toner image from the drum, the AC detack corotron 13 lowers the potential on the back of the sheet. The detack corotron deposits both positive and negative ions onto the back of the sheet at about 60 times per second, i.e. the frequency of the line source. The net charge on the back of the sheet rapidly approaches the potentials on the drum thereby significantly reducing the electrostatic force holding the sheet to the drum. The sheet then separates from the drum due to its beam strength and the curvature of the drum. In some cases, a mechanical finger is inserted between the sheet and drum to effect, or to insure, the separation or stripping of the sheet.

The separated sheet is guided past a fuser 14 that heats the toner material to a tacky condition. Upon cooling, the toner image is permanently bonded to the paper. The copy is thereafter collected in the tray 15.

Meanwhile, the drum surface from which the toner image is transferred is cleaned of residual toner by a rotating fiber brush 16. Finally, the drum surface is passed under the AC erase corotron 17. Corotron 17 deposits positive and negative ions onto the drum at about sixty times per second, i.e. the frequency of the line source. The net effect is to erase any residual latent image and restore the drum surface to a substantially uniform potential near ground. The surface is then ready for repeating the foregoing copying cycle.

The erase corotron is located between the cleaning means, the brush 16 here, and the transfer station in some electrostatographic machines. Also, other AC and DC corotrons are sometimes employed. For example, corotrons are known to be used to effect the potentials of a latent electrostatic image prior to development. Corotrons are also known to be used to effect the toner image and drum potentials after development and prior to transfer.

The tracking high voltage power supply circuit of the present invention is shown in a simplified schematic in FIG. 1. The DC charge corotron 4 is the master corotron and the DC transfer, AC detack and AC erase corotrons are the tracking corotrons. The shields 18, 19 and 20 of the tracking corotrons are electrically coupled to ground 2 whereas the charge corotron shield 21 is coupled to the feedback circuit 23 of the tracking high voltage power supply 24.

Circuit 24 includes input terminals 25*a* and *b* for coupling to a 115+ volt 50–60 hertz line voltage source. The line voltage is applied through valve means 26 for varying the energizing voltage to all the corotrons. The rectifier means includes the conventional transformer 28. The primary winding 30 has the line voltage applied to it as modified or varied by valve means 26. The secondary windings 31 and 32 have roughly a 60:1 winding ratio relative to the primary 30 for generating the high peak voltages needed by the corotrons. The dot symbols 33 indicate the two secondaries are wound oppositely to each other and produce signals that are 180° out of phase. Collectively, the secondaries 31 and 32 and the diodes 34 and 35 effect, at junction 36, a full wave rectification of the voltage applied to the primary 30. This full wave rectified voltage is coupled over line 37, unfiltered, to the coronode of the charge corotron 4.

Separately, the secondaries 31 and 32 couple an AC voltage from the input terminals to the two AC corotrons 17 and 13 respectively. The two AC corotrons are driven from the separate windings to balance the load on the transformer. Also, the 180 degree out of phase relation between the voltages coupled to the detack 13 and erase 17 corotrons is intentionally selected.

The shield current at the charge corotron 4 is used to vary the voltage applied to primary 30. The current from shield 21 is averaged by a capacitor and compared to a reference in the feedback circuit 23 to develop a correction signal. The correction signal in turn is applied to the valve means 26 to increase or decrease the line voltage to return the shield current back to a preselected level. Since the voltages applied to the tracking corotrons 12, 13 and 17 are also derived from the line voltage, they too experience the same correction as the charging corotron 4.

The prior art teaches the open loop operation of a single corotron and the closed loop operation of selected corotrons in an electrostatographic imaging system. The Codichini et al U.S. Pat. No. 3,275,837 mentioned above even discloses the use of a common power supply for the charge, transfer and erase (called a preclean corotron in the patent) corotrons of an imaging system. However, the common power supply includes a CVT that is able to protect all the corotrons from fluctuations in line voltage but does not include feedback to correct for variations at the load.

In the present invention, one corotron is regulated in a closed loop and the other image system corotrons track the regulated corotron. In addition to this tracking concept, unexpected, surprising and significant image system performance is achieved by choosing to operate the DC corotrons with an unfiltered rectified voltage derived from the same source as the AC voltages applied to the AC corotrons. Firstly, elimination of the filter—usually a capacitor—is a meaningful cost saving. Secondly, excellent tracking is achieved because of the commonality of voltage wave form at all the corotrons. The object is to match the shapes of the voltage wave forms applied to the various corotrons as close as possible. The use of the common wave form means that a correction for one corotron is linearly related to a correction for the other corotrons. In contrast, when a constant DC voltage coupled to a DC corotron is varied to correct for an error, a like correction made to an AC voltage coupled to an AC corotron, or an unfiltered, rectified AC voltage coupled to a DC corotron, does not correct the error. Thirdly, the use of an unfiltered, rectified AC voltage at the charge and transfer corotrons saves power, lowers ozone emission and expands the image system latitude for variations in transfer paper thickness, humidity and temperature. In addition, the safety of the supply is greatly improved over filtered supplies because the only energy storage is that in the distributed line capacitance.

Figure 2:
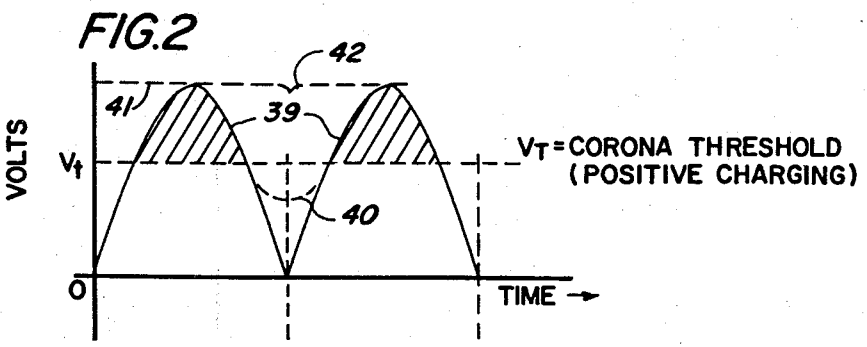
FIG. 2 depicts an approximation of the unfiltered, full wave rectified voltage (a pulsating DC voltage) applied to the charging and transfer corotrons of FIG. 1.

Before the above benefits are explored further, attention is directed to FIG. 2. FIG. 2 shows the unfiltered, full wave, AC voltage applied to the charging and transfer corotrons 4 and 12. The level Vt is the corona threshold voltage level. The shape of the voltage curve 39 in practice is more square, i.e. the top is flat or clipped, rather than sinusoidal. Also, the capacitance associated with the circuit 24 keeps the voltage from falling below the level indicated by dashed line 40. A filtered, full wave rectified AC voltage, by way of comparison, is shaped generally like the dashed line 41. The filtered voltage is a constant voltage level with a 100 or 120 hertz ripple, indicated by peaks 42, impressed on the constant level.

The area under the curve 39 and above the corona threshold voltage Vt is approximately fifty percent of the area between the DC level 41 and the threshold level. Consequently, the charging and transfer corotrons 4 and 12 consume roughly half the power and generate half the ozone of corotrons operated with a filtered DC voltage.

Figure 4:
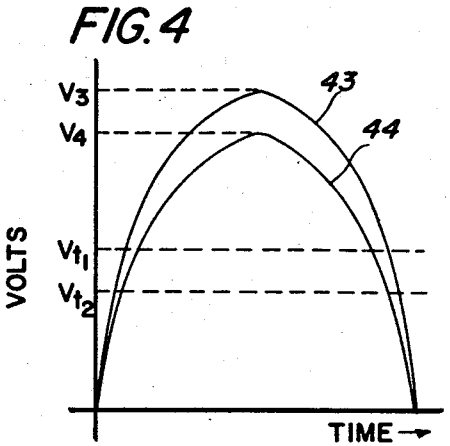
FIG. 4 depicts the non-linear relationship between changes to constant voltage levels and changes to peak values of a sine wave.
Figure 3:
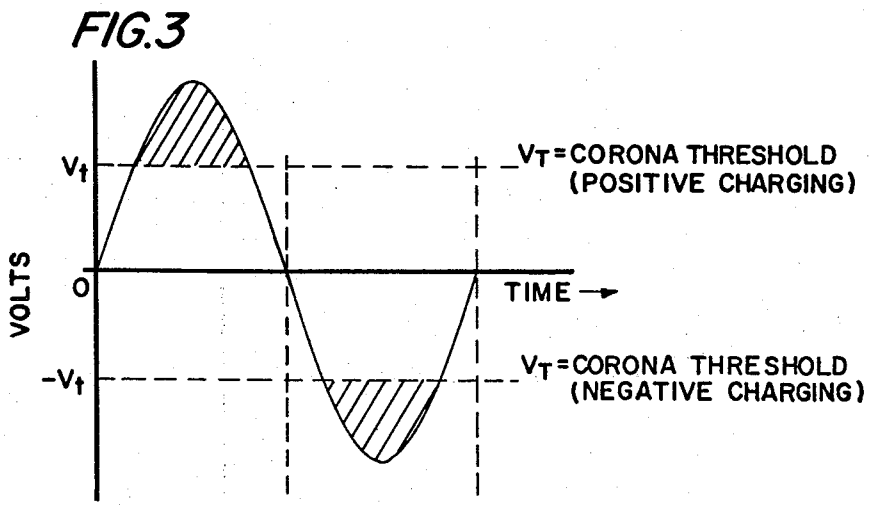
FIG. 3 depicts an approximation of a 60 cycle AC voltage output from one of two secondary windings of the transformer in FIG. 1, one of which is coupled to one of the two AC corotrons in FIG. 2. A like voltage but 180 degrees out of phase is coupled from the other secondary to the other AC corotron.

FIG. 4 is helpful to explain why an AC corotron or a DC corotron energized with an unfiltered, rectified voltage do not successfully track changes at a DC corotron having a constant voltage applied to it. In FIG. 4, the ambient temperature and humidity is assumed to change the corona threshold voltage from $Vt_1$ to $Vt_2$. A DC feedback circuit detects an increase in shield current and makes a corresponding level change in the DC voltage. An AC voltage (rectified or not) applied to a tracking corotron has its amplitude lowered from $V_3$ to $V_4$ proportional to the change in the DC voltage at the DC corotron. However, the correction is not linearly related to the error signal. That is, the area between curve 43 and level $Vt_1$ is not the same as the area between curve 44 and level $Vt_2$. Consequently, the tracking corotron is not generating the same charge after the correction is made and level $Vt_1$ is not the same as the area between curve 44 and level $Vt_2$. Consequently, the tracking corotron is not generating the same charge after the correction is made by the feedback circuit. In other words, the AC corotron is poorly tracking the DC corotron. In contrast, when the master and tracking corotrons have the same voltage wave shapes applied to them, a correction to the voltage of one corotron is appropriate for the voltage to the other corotrons. However, heretofore, it was not known or obvious that the common regulation of mixed AC and DC corotrons could be achieved by use of a common wave form since one corotron is an AC device and the other a DC device.

Figure 5:
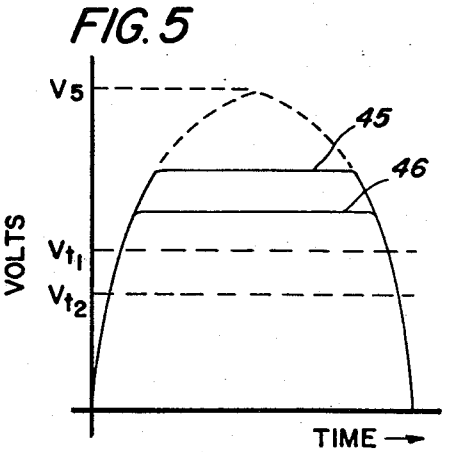
FIG. 5 depicts the manner in which the voltage applied to the corotrons in FIG. 1 is varied to correct for changes in corotron shield current.

The preferred method of varying or controlling the input voltage is to change the level at which the positive and negative peaks of the line voltage are clipped. The valve means 26 in FIG. 1 is, in the preferred embodiment, a diode bridge having means for varying the clipping level. The positive half of a sine wave with a peak voltage of V5, shown in FIG. 5, represents the line voltage. The waves 45 and 46 illustrate two different clipped wave forms passed by the valve means 26. The wave 45 is clipped to yield wave 46 to compensate for the shift in the threshold voltage from $Vt_1$ to $Vt_2$ in the above example associated with FIG. 4. In this case, the shield current itself has substantially the same wave shape as waves 45 and 46 thereby enabling the proper correction to be made. Also, the correction made to the master corotron is proportional as that made to the tracking corotrons because the matter and tracking corotrons are energized with a voltage having substantially the same wave shape.

A noteworthy increase in latitude for an imaging system is the increase in tolerance for variations in paper thicknesses and for moisture content. Paper thickness and moisture content (related to temperature and humidity) effect the transfer and detack processes. For thick paper the transfer field in the toner image areas is difficult to maintain at a sufficiently high level. For thin paper, the high transfer fields are easily achieved but they are so great in the background regions that stripping becomes very difficult. Consquently, a system design objective is to achieve effective transfer and stripping for a wide variety of transfer papers. The boundaries of the latitude are conveniently expressed as the thick and thin paper conditions. The latitude boundaries could also be expressed in terms of wet and dry papers. However, only the paper thickness example is believed necessary to discuss in order to explain the benefit achieved by the instant invention.

The beneficial aspect of the instant invention is apparent from an examination of the potential, Vp, on the backside of the transfer paper 9 in FIG. 1. The dynamic expression for Vp is:

$$Vp = (V_D + \frac{b}{a})\, e^{\frac{at}{c}} - \frac{b}{a} \qquad \text{equation (1)}$$

where $V_D$ is the potential of the drum, t is time, c is capacitance which is related to the thickness (and moisture content) of the paper 9, b is the maximum corotron charging current and "a" is the slope of curves 48, 49 and 50.

Figure 6:
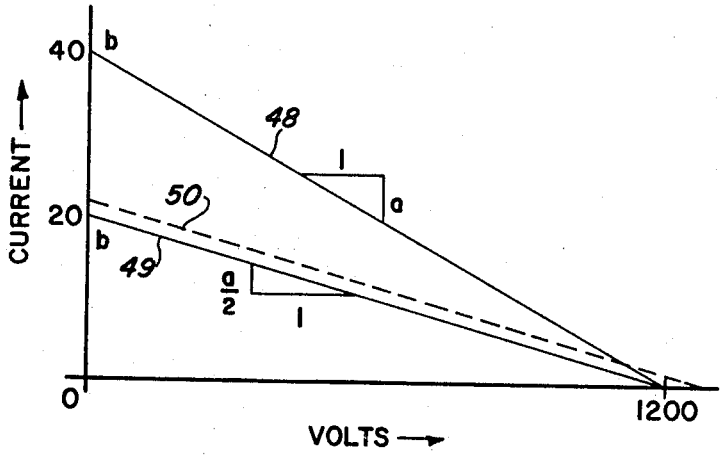
FIG. 6 is a graph used to explain that the unfiltered, full wave rectified voltage applied to the charging and transfer corotrons in FIG. 1 is advantageous in comparison to constant DC potentials.

Equation (1) is solved, or bounded, by empirically determining values for b and a for a given corotron. The graph in FIG. 6 is a first order approximation of the current and voltage relation empirically determined for a corotron above a grounded plate having an insulating surface facing the corotron, (a specific example is the corotron 12 spaced above drum 1, in the dark, as shown in FIG. 1.) The vertical axis of the graph is the corotron current i and the horizontal axis is the plate voltage V. The maximum current b, occurs when the plate voltage is zero and the zero current condition occurs at a determinable voltage. Zero current occurs for a corotron without a shield when the potential difference between the platen and the coronode wire is equal to or less than the corona threshold voltage. Zero current occurs for a corotron with a shield when the potential difference between the plate and corotron is inadequate to give rise to an ion flow between them. The zero current condition occurs at 1200 volts in the empirical case represented by FIG. 6.

Curve 48 in FIG. 6 is for a corotron having a constant DC voltage coupled to it. Curve 49 is for the same corotron having an unfiltered, full wave rectified AC voltage coupled to it as taught by the present invention. Curve 49 has a maximum current $b=20$ that is about half that for curve 48 ($b=40$). This ½ value for b is understood by referring back to FIG. 2. From a visual inspection of curves 39 and 41 in FIG. 2, it is seen that the ion current period for an unfiltered, full wave rectified AC voltage described by curve 39 is about half that of the ion current for a DC voltage described by curve 41. The zero current condition is substantially the same for the two curves 48 and 49 in this first order approximation. Accordingly, the slope for curve 49 is half that for curve 48 for the values given.

Table I is a compilation of the solutions of equation (1) using the numbers for "b" and "a" derived from FIG. 6. Also, the capacitance value of $c=24$ represents a thin paper 9 and $c=12$ represents a thick paper. The time $t=1000$ units is arbitrarily selected. The slope values of $-0.03333$ and $-0.01666$ are the actual slopes for curves 48 and 49 for the values given. The drum voltage $V_D=800$ volts is generally the maximum value for the image area of a latent electrostatic image in the system of FIG. 1. Similarly, $V_D=100$ volts is generally the minimum value for the background area of a latent image in the system of FIG. 1.

TABLE I

| | $V_p$-$V_D$ | $V_p$ | $V_D$ | a | b | c | t |
|---|---|---|---|---|---|---|---|
| line 1 | 375.13 | 1175.13 | 800 | −.03333 | 40 | 12 | 1000 |
| line 2 | 300.26 | 1100.26 | 800 | −.01666 | 20 | 12 | 1000 |
| line 3 | 825.71 | 925.71 | 100 | −.03333 | 40 | 24 | 1000 |
| line 4 | 550.7 | 650.7 | 100 | −.01666 | 20 | 24 | 1000 |
| line 5 | 398.4 | 1198.4 | 800 | −.03333 | 40 | 12 | 2000 |
| line 6 | 375.13 | 1175.13 | 800 | −.01666 | 20 | 12 | 2000 |
| line 7 | 1031.6 | 1131.6 | 100 | −.03333 | 40 | 24 | 2000 |
| line 8 | 825.71 | 925.71 | 100 | −.01666 | 20 | 24 | 2000 |
| line 9 | 398.0 | 1198.0 | 800 | −.01666 | (20.4) | 12 | 2000 |
| line 10 | 843.72 | 943.72 | 100 | −.01666 | (20.4) | 24 | 2000 |

$V_p-V_D$ represents the field for transferring a toner image from the drum 1 to paper 9. It also represents the force required to strip or separate the paper from the drum.

The intent of Table I is to demonstrate the advantages of the instant invention for opposite extremes of paper thickness. For thick paper (C=12) the transfer and stripping fields are low which is bad for transfer but good for stripping. Consequently, for thick paper, only the 800 volt image areas associated with curve 48 and 49 corotrons need be compared since if transfer is achieved, a priori, stripping is achieved. Similarly, for thin paper (C=24), the transfer and stripping fields are high which is good for transfer but bad for stripping. Therefore, for thin paper, only the 100 volt background areas for the curve 48 and 49 corotrons need be compared since if stripping is feasible, a priori, transfer is feasible.

Lines 1 and 2 illustrate the transfer field in the 800 volt image areas for thick paper. Line 1 is for the prior art corotron of curve 48 and line 2 is for the present corotron of curve 49. A comparison of the transfer field, $V_p-V_D$ shows that the present corotron achieves 80 percent of the prior art corotron transfer field. The absolute valve of 300 volts in line 2 is adequate for transfer.

Lines 3 and 4 illustrate the stripping fields in the 100 volt background areas for thin paper. Line 3 is for the prior art corotron and line 4 is for the present corotron. Here, the present corotron is seen as providing 67 percent of the stripping force compared to the prior art corotron.

Lines 5–8 repeat the order of the first four lines with the time $t=2000$. These lines illustrate that when longer charging times are permitted that the increased latitude or tolerance for paper thickness variations are even greater if the time is available. The time is clearly available in the 3–6 inches per second copying speeds for the copying machine of FIG. 1. Looking at lines 5 and 6 shows that the curve 49 corotron achieves 94 percent of the transfer field of the prior art corotron. Lines 7 and 8 show that the present corotron, despite the longer time, still gives a 20 percent reduction in the stripping field.

Lines 9 and 10 are the same as lines 6 and 8 but with the initial current increased a small percentage to 20.4 microamps. The parenthesis are used around the number merely to flag this change. The increased current is obtained, by way of example, by making the wave shape in FIG. 2 more square, increasing the amplitude of the peak voltage, changing the frequency, or a combination of the foregoing. The main point is that a very small change in the charging current of a curve 49 type corotron yields a significant latitude extension. The curve 50 in FIG. 6 defines the operating conditions for this slightly higher biased corotron.

Compare lines 6 and 9 to see what happens to the transfer field. It is substantially the same as for the DC prior art corotron of line 5. Now compare line 7 and line 10 to see if the effect of the change in b had on the stripping force. The stripping force hardly increased going to 82 percent from 80 percent of the prior art value of line 7.

From the foregoing, an unexpected increase in transfer and detack performance is obtained by operation of the DC corotrons in an electrostatographic system with a full wave rectified AC voltage as seen in FIG. 2 (pulsated DC of 120 hertz). Of course, the wave shape of FIG. 2 can be triangular, clipped sinusoid, a rectangle or a trapozoid. The key is that it have an effective slope similar to curve 49 in FIG. 6. Preferrably, the curve 49 corotron should be adjusted to operate as a curve 50 corotron to give even wider system performance. Curve 50 represents the preferred case where the pulsating DC voltage exceeds the corona threshold level for about from 50 to about 55 percent of its wavelength. The benefits of paper latitude expansion are nonetheless realizable for pulsating voltages that exceed threshold over a range of from about 40 to about 80 percent of its wavelength. The speed of the copying system is a factor that must be considered. The lower percentage is appropriate for slower copy rates.

Figure 7:
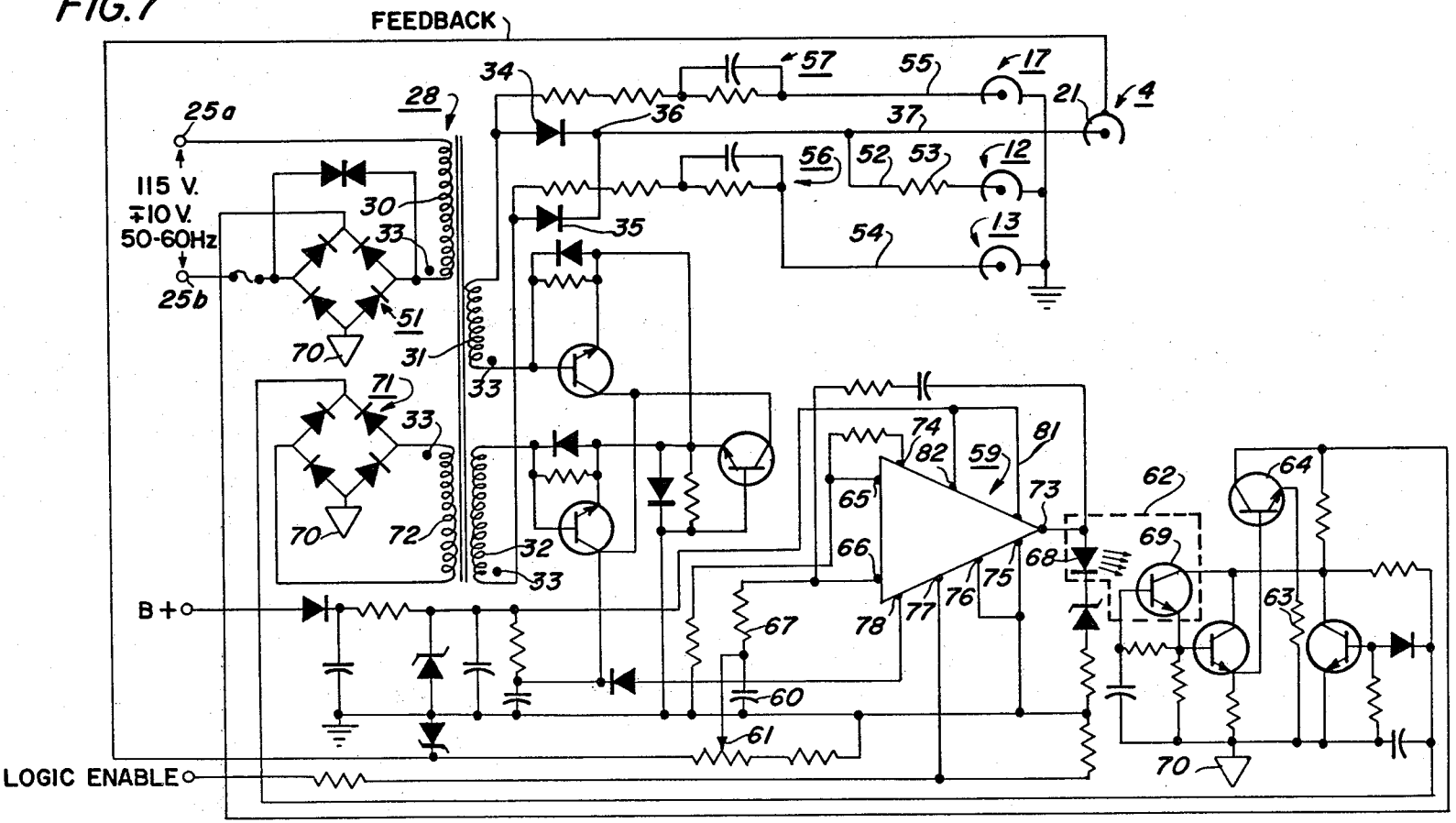
FIG. 7 is a detailed circuit diagram of the tracking high voltage power supply in FIG. 1.

The details of the tracking high voltage power supply circuit are shown in FIG. 7. Items common to FIGS. 1, 7 and 8 have like reference numbers. The 115 volt±10 volt 50–60 hertz line source is coupled to terminals 25*a* and *b*. The diode bridge 51 is part of the valve means 26 of FIG. 1. The bridge 51 clips off the top of the positive and negative half cycles of the line voltage as illustrated in FIG. 5. The exact clipping level is varied up and down within limits in response to changes in the current at shield 21 of charge corotron 4.

The clipped line voltage is applied to the primary 30 of transformer 28. The oppositely wound secondaries 31 and 32 along with diodes 34 and 35 collectively comprise a full wave rectifier. The unfiltered, full wave rectified AC voltage at junction 36 is coupled over line 37 to the coronode of the charge corotron 4. That same voltage is coupled to the transfer corotron 12 from junction 36 via line 52 that includes the resistor 53. Resistor 53 appropriately lowers the potential coupled to the transfer corotron. The transfer corotron voltage is adjusted—for the reasons apparent from the discussion of Table I—to strike a compromise between transfer field and stripping field. The transfer voltage can also be obtained by adding two rectifying diodes corresponding to diodes 34 and 35 to intermediate windings on the secondaries 31 and 32. However, a dropping resistor, such as resistor 53, is preferred to a separate rectifier because the voltage wave shapes applied to the corotrons are more closely matched.

The amplified AC voltages from secondaries 31 and 32 and lines 54 and 55 are the means for coupling an AC voltage to the detack and erase corotrons 13 and 17. The parallel R–C circuits 56 and 57 in series with leads 54 and 55 adjust the voltage level and balance the reactance to their respective corotron so that they produce substantially equal quantities of charge on both the positive and negative half cycles. This is because their object is to neutralize charge.

The principal elements of feedback circuit 23 are: the differential amplifier 59; an input network to the amplifier including capacitor 60 and potentiometer 61; the optical isolator 62 coupled to the output of amplifier 59; and, the valve means 26 which includes the resistor 63 in the emittor circuit of transistor 64.

The amplifier 59 has two input terminals 65 and 66. A reference level of about 2 volts is coupled to input 65. The shield current from corotron 4 is coupled to input terminal 66 through the input network including capacitor 60 and potentiometer 61. The values of the input network components and of resistor 67 are selected to define a null voltage or operating level at the output of amplifier 59. The amplifier produces the null voltage when the shield current 21 is at a desired value. When the shield current varies from the desired value, a correction voltage is developed at the output of amplifier 59 to drive the error in shield current to zero. This it does by varying the clipping level of the line voltage as indicated in FIG. 5. The optical isolator 62 electrically isolates the machine ground from the 115 volt line voltage. In addition, it isolates the correction signal from the electrical noise abundantly present in corotron environments. The triangle symbol 70 represents a common line and not machine ground. The output of amplifier 59, through the optical isolator and related components, regulates the base current of transistor 64 thereby regulating the clipping level of the positive and negative cycles of the line voltage. Bridge 51 reverses the connections to transistor 64 on each half cycle to enable it to clip both the positive and negative peaks.

The diode bridge 71 is coupled to primary 72 of transformer 28 to develop appropriate bias levels for the operation of the optical isolator 62 and the valve means 26 which includes the transistors coupled to the output of the optical isolator 62.

The remainder of the elements in the circuit of FIG. 7 are for establishing bias levels and for protection of users and equipment during open or short circuit conditions. These features are well understood by those skilled in the art from an inspection of the circuit of FIGS. 1, 7 and 8.

Figure 8:
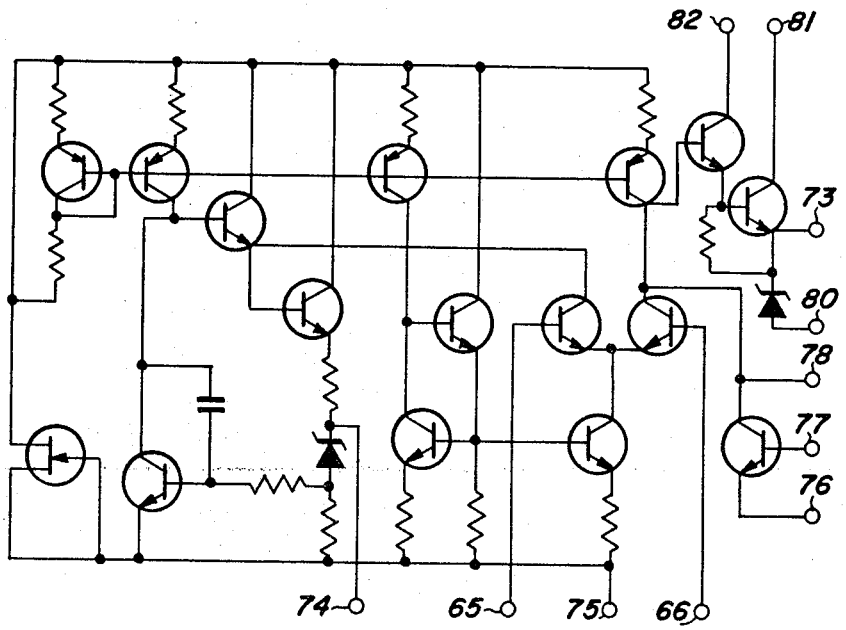
FIG. 8 is a circuit diagram of the differential amplifier illustrated in FIG. 7.

The differential amplifier 59 in FIG. 7 is a product of the Fairchild Instrument Corporation. It is their model uA723, type 723, part number 723DM, 14 lead DIP, Precision Voltage Regulator, a Fairchild integrated circuit. FIG. 8 gives the equivalent circuit published by the manufacturer. Again, like items in FIG. 7 and 8 have like reference numbers. The error signal from the charging corotron shield 21 (FIG. 1) is applied at input terminal or Pin 66 of the amplifier 59. Pin 65 is the other input to which a reference potential of about 2 volts is coupled. The output, of amplifier 59 (the correction signal) is at pin 73. This pin is coupled to optical isolator 62. Pin 74 is a $V_{ref}$ terminal. Pin 75 is the V− terminal. Pins 76, 77 and 78 are the current sense, current limit and compensation terminals respectively. Pins 80, 81 and 82 are the $V_z$, $V_c$ and V+ terminals respectively for the circuit.

The foregoing description is for the specific case of one master corotron and three slave corotrons. Also, the description is aimed at the case where the master corotron is the charging corotron of an electrophotographic copying machine. The operation of the charge corotron is important to control because the copying process is dependent upon it in terms of uniformity within a single image and for repeatability from image cycle to image cycle. In the system of FIG. 1, the charge corotron was judged the most important to control with the others being adequately regulated by tracking the changes in the charge corotron. The system of FIG. 1 is a low speed, low cost copier. In other applications, the charge corotron can be regulated separately and the transfer corotron, e.g. corotron 12 in FIG. 1, can be the master corotron with the two AC corotrons the sole tracking devices. Naturally, other combinations are possible provided there is at least one master and one tracking corotron. In addition, an AC corotron can be the master and an AC corotron or a DC corotron can be the tracking corotron. Furthermore, in some electrostatorgraphic imaging systems, AC and DC corotrons are used at positions between exposure station 5 and development means 6 and between development means 6 and the transfer corotron 12. These too may be regulated either as the master or as a tracking corotron to suit a given application.

The system of FIG. 1 has a copy production speed of from about 3 to 6 inches per second. The 100 or 120 hertz component of the charging corotron 4 produces a strobing pattern in the charge placed on drum 1. However, the 100 or 120 hertz frequency is outside the sensitivity of the human eye and the strobing does not aversely impact the final copy quality. Also, the width of the charging beam is variable to suppress the amplitude of the modulated or strobed charge pattern. In the preferred embodiment of FIG. 1, the beam width is about one half inch, i.e. the ion flow to the drum extends laterally about one half inch in the plane of the paper in FIG. 1.

The foregoing modifications to the specific embodiment disclosed and other modifications suggested hereby are intended to be within the scope of the instant invention.

What is claimed is:

1. A tracking power supply circuit for a mixture of AC and DC corotrons comprising means for generating a pulsating DC voltage from an AC voltage having a wave shape corresponding to the wave shape of the AC voltage, means for coupling the pulsating DC voltage to a DC Corotron, means for coupling an AC voltage having corresponding wave shape to an AC corotron and feedback means coupled to only one of the corotrons and valve means for varying all the AC and pulsating voltages coupled to the corotrons.

2. A tracking power supply circuit for regulating multiple corotrons at least one of which is a DC corotron comprising input means for coupling to an AC voltage source, rectifier means coupled to the input means for rectifying an AC voltage, first coupling means for coupling an unfiltered, rectified AC voltage to a DC corotron for operation of the corotron, second coupling means for coupling an AC voltage from the input means or an unfiltered, rectified voltage from the rectifier means to a second corotron for operation of the corotron, feedback regulator means coupled to only one of said corotrons and the input means for varying an AC voltage at the input means to regulate the voltages applied to all the corotrons in response to variations at the corotron to which the regulator means is coupled.

3. The circuit of claim 2 wherein said feedback means includes valve means for clipping the tops of the positive and negative half cycles of an AC voltage source applied to the input means.

4. The circuit of claim 2 wherein said second coupling means couples an unfiltered, rectified voltage to a second DC corotron.

5. The circuit of claim 2 wherein said second coupling means couples an AC voltage to an AC corotron and wherein said regulator means is coupled to the DC corotron.

6. The circuit of claim 2 wherein said second coupling means couples an AC voltage to an AC corotron and wherein said feedback regulator means is coupled to the AC corotron.

7. The circuit of claim 2 wherein said second coupling means couples an unfiltered, rectified AC voltage to the second corotron that is a DC corotron and wherein said feedback regulator means is coupled to one of said DC corotrons and further including third coupling means for coupling an AC signal from the input means to a third corotron that is an AC corotron.

8. The circuit of claim 7 further including fourth coupling means for coupling an AC voltage from the input means to a fourth corotron that is an AC corotron.

9. The apparatus of claim 2 wherein said rectifier means includes means for full wave rectification of an AC voltage from the input means.

10. The apparatus of claim 2 wherein said regulator means includes noise isolation means for isolating the regulator means from electrical noise.

11. In electrostatographic imaging apparatus of the type employing multiple corotrons, at least one of which is a DC corotron, in an electrostatic charge process involving the creation of latent electrostatic images, the improvement being circuit means for regulating a voltage applied to all the corotrons in response to changes at one corotron comprising input means for coupling to an AC voltage source, rectifier means coupled to the input means for rectifying an AC voltage from the input means, first coupling means for coupling an unfiltered, rectified AC voltage from the rectifier means to the DC corotron for operation of the corotron, second coupling means for coupling either an AC voltage from the input means or an unfiltered, rectified voltage from the rectifier means to a second corotron, feedback regulator means coupled between one of said corotrons and the input means for varying an AC voltage in response to variations at the corotron to which it is coupled to regulate the voltages coupled to all the corotrons.

12. The apparatus of claim 1 wherein said regulator means includes valve means for clipping the tops of the positive and negative half cycles of an AC voltage coupled to the rectifier means and the second coupling means.

13. The apparatus of claim 11 wherein said regulator means includes optical isolation means to isolate the regulation means from electrical noise.

14. The apparatus of claim 11 wherein said second corotron is a DC corotron.

15. The apparatus of claim 11 wherein said second corotron is an AC corotron and said regulator means is coupled to the DC corotron.

16. The apparatus of claim 11 wherein said second corotron is an AC corotron and said regulator means is coupled to the AC corotron.

17. Electrophotographic imaging apparatus comprising a photoconductive member having an imaging surface for formation of latent electrostatic images, a DC charging corotron for depositing charge on the imaging surface of the photoconductive member exposure means for exposing the charged photoconductive member to electromagnetic radiation to create a latent electrostatic image on the imaging surface, development means for depositing a toner material on the image surface to develop a toner image corresponding to the latent image, transfer means for transferring toner images from the photoconductive member to the front side of a support member including a DC transfer corotron for depositing charge on the backside of a support member for electrostatic transfer of the toner image and tracking circuit means including input means for coupling to an AC voltage source, rectifier means coupled to the input means for rectifying an AC voltage from the input means, first coupling means for coupling an unfiltered, rectified voltage from the rectifier means to the DC charging corotron, second coupling means for coupling an unfiltered, rectified AC voltage to the DC transfer corotron and feedback means coupled to one of said corotrons and the input means for varying an AC voltage in response to variation at the corotron to which it is coupled to regulate the current at all the corotrons.

18. The apparatus of claim 17 wherein the corotron coupled to the feedback means includes a coronode wire coupled to the unfiltered, rectified AC voltage and shield means coupled to said feedback means.

19. The apparatus of claim 17 wherein said feedback means is coupled to the DC charging corotron and wherein said transfer means further includes an AC detack corotron coupled to said input means for neutralizing charge on the back side of a support member to which a toner image has been transferred to enhance the separation of the support member from the photoconductive member.

20. The apparatus of claim 17 further including an AC erase corotron coupled to said input means for neutralizing charge on the imaging surface of the photoconductive member after toner images have been transferred therefrom.

21. The apparatus of claim 20 further including cleaning means for removing residual toner material from the photoconductive member in preparation for reusing the imaging surface from which a toner image has been transfer after the transfer and before charging of the imaging surface by the DC charging corotron and wherein the AC erase corotron is positioned to neutralize the imaging surface before the cleaning means begins removing said residual toner material.

22. The apparatus of claim 21 wherein the AC erase corotron is positioned to neutralize charge on the image surface after residual toner material has been removed by the cleaning means.

23. Electrophotographic imaging apparatus comprising toner image forming means including a photoconductor, charging means for charging a surface of the photoconductor, exposure means for creating a latent electrostatic image by exposing the charged photoconductor to electromagnetic radiation and development means for depositing a toner material onto the latent image to develop a toner image corresponding to the latent image, transfer means for transferring toner images from the photoconductor to the front side of a support member including a DC transfer corotron for depositing charge on the backside of the support member for electrostatic transfer of the toner image and an AC detack corotron for neutralizing charge on the backside of the support member after the transfer of the toner image to enhance the separation of the support member from the photoconductor and tracking circuit means including input means for coupling to an AC voltage source, rectifier means coupled to the input means for rectifying an AC voltage coupled to it, first coupling means for coupling an unfiltered, rectified AC voltage from the rectifier means to the transfer corotron for operation of the corotron, second coupling means for coupling an AC voltage from the input means to the AC detack corotron for operation of the corotron and feedback means coupled to either the DC transfer corotron or the AC detack corotron and to the input means for varying an AC voltage in response to variations at the corotron to which it is coupled to regulate both the transfer and detack corotrons.

24. The apparatus of claim 23 wherein said feedback means includes valve means coupled to the input means for clipping the tops of the positive and negative half-cycles of an AC voltage coupled to the rectifier means and the second coupling means.

25. The apparatus of claim 23 wherein said feedback means includes noise isolation means for isolating the AC voltage from electrical noise.

26. The apparatus of claim 23 wherein the DC transfer corotron is coupled to the feedback means.

27. The apparatus of claim 23 wherein the AC corotron is coupled to the feedback means.

28. The apparatus of claim 23 further including an AC erase corotron coupled to an AC voltage from the input means by a third coupling means for neutralizing charge on the photoconductor after the transfer of toner images therefrom.

29. The apparatus of claim 28 further including cleaning means for removing residual toner on the photoconductor after transfer of toner images and wherein the cleaning means is located to operate on the photoconductor after the transfer of a toner image but before the neutralizing of charge by the AC erase corotron.

30. The apparatus of claim 29 wherein said cleaning means is located to operate on the photoconductor after the neutralizing of charge by the AC erase corotron.

31. The apparatus of claim 23 wherein said DC transfer corotron includes coronode means coupled to the unfiltered, rectified AC voltage and shield means coupled to said feedback means.

32. The apparatus of claim 23 wherein said rectifier means full wave rectifies an AC voltage applied to it.

* * * * *